US011226571B2

(12) United States Patent
Kosuge et al.

(10) Patent No.: US 11,226,571 B2
(45) Date of Patent: Jan. 18, 2022

(54) IMAGE FORMING APPARATUS THAT CONTROLS A CHARGING BIAS BASED ON AN ESTIMATED SURFACE POTENTIAL

(71) Applicants: Akio Kosuge, Kanagawa (JP); Yuji Suzuki, Tokyo (JP); Daisuke Takahashi, Kanagawa (JP); Shinichi Akatsu, Kanagawa (JP); Daisuke Ito, Kanagawa (JP)

(72) Inventors: Akio Kosuge, Kanagawa (JP); Yuji Suzuki, Tokyo (JP); Daisuke Takahashi, Kanagawa (JP); Shinichi Akatsu, Kanagawa (JP); Daisuke Ito, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/986,265

(22) Filed: Aug. 6, 2020

(65) Prior Publication Data

US 2021/0041800 A1 Feb. 11, 2021

(30) Foreign Application Priority Data

Aug. 9, 2019 (JP) ..... JP2019-148048
Jan. 22, 2020 (JP) ..... JP2020-008540
Apr. 16, 2020 (JP) ..... JP2020-073354

(51) Int. Cl.
*G03G 15/02* (2006.01)

(52) U.S. Cl.
CPC ..... *G03G 15/0266* (2013.01)

(58) Field of Classification Search
CPC ..... G03G 15/0266; G03G 15/05; G03G 21/08
See application file for complete search history.

(56) References Cited

U.S. PATENT DOCUMENTS 5,701,551 A * 12/1997 Honda ..... G03G 15/0266 399/50
2012/0328332 A1 12/2012 Kosuge et al.
2017/0075264 A1* 3/2017 Kanatani ..... G03G 21/08

FOREIGN PATENT DOCUMENTS

JP 6-035302 2/1994
JP 2006-276256 10/2006
JP 2006276256 * 10/2006 ..... G03G 15/00
JP 2007-187933 7/2007
JP 2012-230141 11/2012
JP 2016-133616 7/2016

* cited by examiner

*Primary Examiner* — Arlene Heredia
(74) *Attorney, Agent, or Firm* — Xsensus LLP

(57) ABSTRACT

An image forming apparatus includes a photoconductor, a charger, a charge remover, and control circuitry. The charger is configured to charge the photoconductor. The charge remover is configured to remove charge from a surface of the photoconductor by light and electric discharge. The control circuitry is configured to: estimate a surface potential that the photoconductor has after the photoconductor is charged by the charger, based on a characteristic value of the photoconductor and a value of a current flowing through the charger after the charge remover removes charge from the photoconductor; and control a charging bias applied to the charger, based on the surface potential estimated.

20 Claims, 7 Drawing Sheets

IMAGE FORMING APPARATUS THAT CONTROLS A CHARGING BIAS BASED ON AN ESTIMATED SURFACE POTENTIAL

CROSS-REFERENCE TO RELATED APPLICATIONS

This patent application is based on and claims priority pursuant to 35 U.S.C. § 119(a) to Japanese Patent Application Nos. 2019-148048, filed on Aug. 9, 2019, 2020-008540, filed on Jan. 22, 2020, 2020-073354, filed on Apr. 16, 2020, in the Japan Patent Office, the entire disclosure of each of which is incorporated by reference herein.

BACKGROUND

Technical Field

Embodiments of the present disclosure relate to an image forming apparatus.

Related Art

Generally, there is known an image forming apparatus including a photoconductor, a charger to charge the photoconductor, and a charge remover to remove charge from the photoconductor. The image forming apparatus, for example, estimates a surface potential of the photoconductor having been charged by the charger based on characteristic values of the photoconductor and a current value flowing in the charger after charge removal by the charge remover, and controls a charging bias applied to the charger to charge the photoconductor based on the estimated surface potential of the photoconductor.

SUMMARY

In an aspect of the present disclosure, there is provided an image forming apparatus that includes a photoconductor, a charger, a charge remover, and control circuitry. The charger is configured to charge the photoconductor. The charge remover is configured to remove charge from a surface of the photoconductor by light and electric discharge. The control circuitry is configured to: estimate a surface potential that the photoconductor has after the photoconductor is charged by the charger, based on a characteristic value of the photoconductor and a value of a current flowing through the charger after the charge remover removes charge from the photoconductor; and control a charging bias applied to the charger, based on the surface potential estimated.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
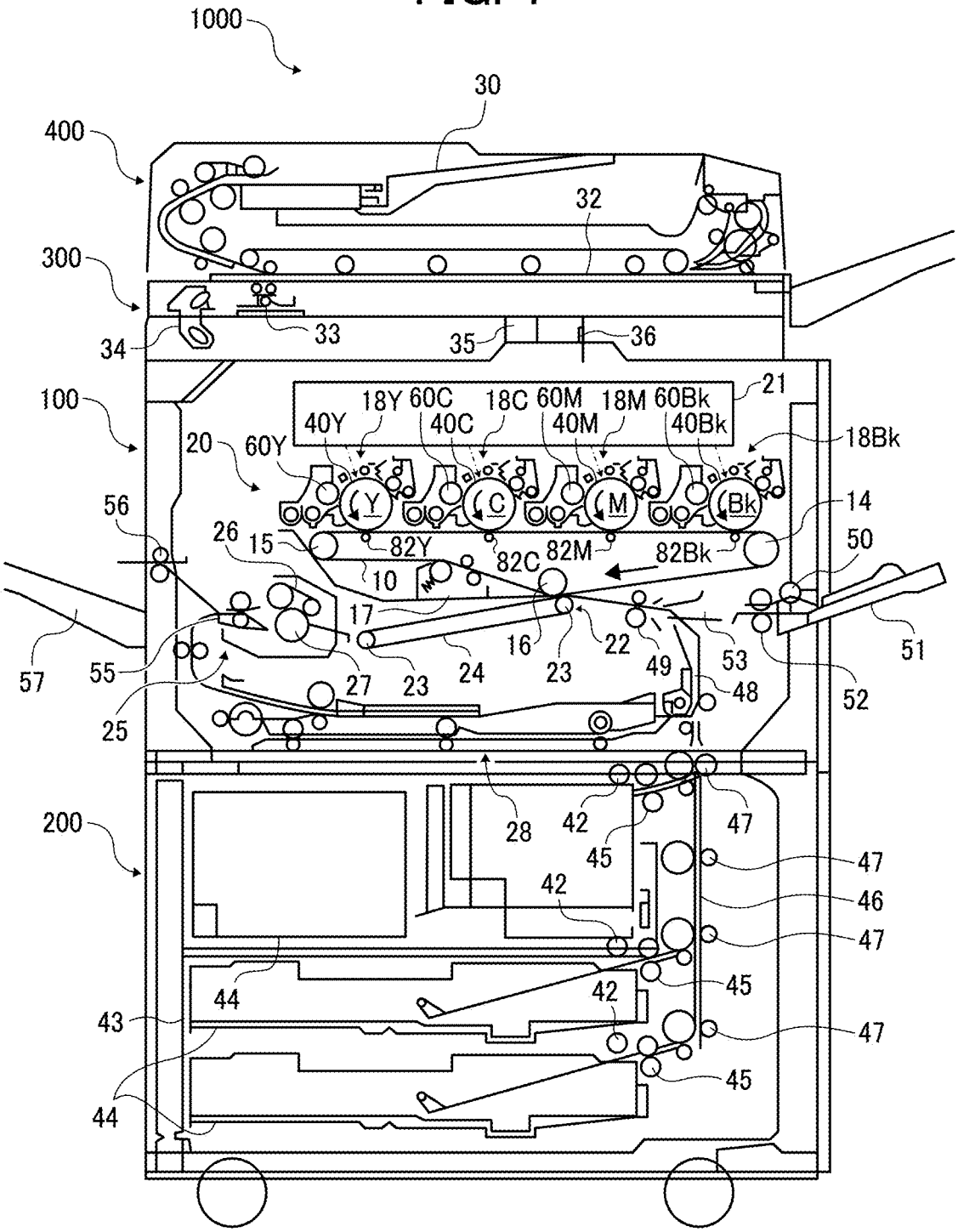
FIG. 1 is a schematic view of an entire configuration of a full-color copier.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results. As used herein, the singular forms "a", "an", and "the" are intended to include the plural forms as well, unless the context clearly indicates otherwise.

Although the embodiments are described with technical limitations with reference to the attached drawings, such description is not intended to limit the scope of the disclosure and all of the components or elements described in the embodiments of this disclosure are not necessarily indispensable.

A description is given of a full-color copier of a tandem intermediate transfer type as an image forming apparatus according to an embodiment of the present disclosure. FIG. 1 is a schematic view of the entire configuration of a full-color copier according to an embodiment of the present disclosure. A full-color copier 1000 according to the present embodiment includes an apparatus body 100, a sheet feeding table 200 on which the apparatus body 100 is mounted, a scanner 300 attached on the apparatus body 100, and an automatic document feeder (ADF) 400 attached on the scanner 300.

A tandem image forming device 20 includes four image forming units 18Y, 18C, 18M, and 18Bk of yellow (Y), cyan (C), magenta (M), and black (Bk) arranged side by side in the center of the apparatus body 100, The image forming units 18Y, 18C, 18M, and 18Bk of the tandem image forming device 20 include photoconductors 40Y, 40C, 40M and 40Bk, respectively, on which toner images of Y, C, M, and Bk are formed.

An exposure device 21 is disposed above the tandem image forming device 20. The exposure device 21 includes four laser diode (LD) type light sources prepared for the four colors, a set of polygon scanner including a polygon mirror of six surfaces and a polygon motor, and lenses and mirrors such as an fθ lens and a long wide toroidal lens (WTL) arranged in the optical path of each light source. Laser beams emitted from the light sources according to image data of respective colors of Y, C, M, and Bk are deflected by the polygon mirror to scan and irradiate the respective surfaces of the photoconductors 40Y, 40C, 40M, and 40Bk (hereinafter, may be collectively referred to as photoconductor(s) 40 unless distinguished).

A seamless intermediate transfer belt 10 is disposed below the tandem image forming device 20. The intermediate transfer belt 10 is wound around three support rollers, that is, a first support roller 14, a second support roller 15, and a third support roller 16 so as to be rotatable and conveyable in a clockwise direction in FIG. 1. The first support roller 14 is a drive roller to rotate and drive the intermediate transfer belt 10. Between the first support roller 14 and the second support roller 15, primary transfer rollers 82Y, 82C, 82M, and 82Bk are disposed as primary transferors to transfer toner images from the photoconductors 40Y, 40C, 40M, and 40Bk to the intermediate transfer belt 10 so as to face the photoconductors 40Y, 40C, 40M, and 40Bk, respectively, across the intermediate transfer belt 10.

An intermediate transfer belt cleaner 17 to remove residual toner remaining on the intermediate transfer belt 10 after image transfer is disposed downstream of the third support roller 16 in a direction of rotation of the intermediate transfer belt 10. As a material of the intermediate transfer belt 10, a resin material such as polyvinylidene fluoride, polyimide, polycarbonate, or polyethylene terephthalate can be molded into a seamless belt. Such a material can be used as it is, or the resistance can be adjusted with a conductive material such as carbon black. In addition, such a resin may be used as a base layer, and a surface layer may be formed by a method such as spraying or dipping to form a laminated structure.

A secondary transfer device 22 is disposed below the intermediate transfer belt 10. The secondary transfer device 22 includes a secondary transfer belt 24 as a seamless belt wound around two rollers 23. The secondary transfer belt 24 is pressed against the third support roller 16 via the intermediate transfer belt 10 to transfer an image on the intermediate transfer belt 10 to a transfer material. As a material of the secondary transfer belt 24, the same material as the intermediate transfer belt 10 can be used.

Next to the secondary transfer device 22, a fixing device 25 is disposed to fix the image on the transfer material. The fixing device 25 is configured to press a pressure roller 27 against a fixing belt 26 that is a seamless belt. The secondary transfer device 22 also has a sheet conveying function of conveying the transfer material after the image transfer to the fixing device 25. A transfer roller or a transfer charger may be provided as the secondary transfer device 22, and in such a case, a function of conveying the transfer material is separately provided.

A reversing device 28 is disposed in parallel to the tandem image forming device 20 below the secondary transfer device 22 and the fixing device 25, to reverse and eject the transfer material, and reverse and refeed the transfer material to form images on both sides of the transfer material.

A document is set on a document table 30 of the ADF 400 when a copying operation is performed using the full-color copier 1000. Alternatively, the ADF 400 is opened, the document is set on an exposure glass 32 of a scanner 300, and the ADF 400 is closed to hold the document. When the document is set on the ADF and a start switch of an operation display unit 515 (see FIG. 5) is pressed, the document is conveyed and moved onto the exposure glass 32, and the scanner 300 drives a first traveling body 33 and a second traveling body 34. On the other hand, when the document is set on the exposure glass 32 and the start switch of the operation display unit 515 is pressed, the scanner 300 immediately drives the first traveling body 33 and the second traveling body 34.

The scanner 300 emits light from the light source by the first traveling body 33, reflects reflection light from a surface of the document to the second traveling body 34. The light reflected by the first travelling body 33 is reflected by a mirror of the second traveling body 34 and input to a reading sensor 36 through an imaging lens 35. Then, the reading sensor 36 reads the content of the document After that, the image forming operation is started in a full-color mode or a black-and-white mode in accordance with the mode setting of an operation unit or the result of reading the document when an automatic mode selection is set with the operation unit.

When the full-color mode is selected, the photoconductors 40Y, 40C, 40M, and 40Bk rotate in the counterclockwise direction in FIG. 1. The surface of each of the photoconductors 40Y, 40C, 40M, and 40Bk is uniformly charged by the charging roller 70 as a charger. Laser beams corresponding to images of the respective colors of Y, C, M, and Bk are irradiated from the exposure device 21 onto the photoconductors 40Y, 40C, 40M, and 40Bk, and latent images corresponding to image data of the respective colors of Y, C, M, and Bk are formed. As the photoconductors 40Y, 40C, 40M, and 40Bk rotate, the latent images are developed with toners of the respective colors of Y, C, M, and Bk by the developing devices 60Y, 60C, 60M, and 60Bk. The toner images of the respective colors of Y, C, M, and Bk are sequentially transferred onto the intermediate transfer belt 10 as the intermediate transfer belt 10 is conveyed. Thus, a composite full-color image is formed onto the intermediate transfer belt 10. After the transfer, a charge removing lamp removes charge from each of the photoconductors 40Y, 40C, 40M, and 40Bk by light, and a cleaner removes residual toner from the surface of each of the photoconductors 40Y, 40C, 40M, and 40Bk.

On the other hand, one of sheet feed rollers 42 of a sheet feed table 43 is selectively rotated to feed a transfer material from one of sheet feed cassettes 44 provided in multiple stages of the sheet feed table 43. Next, a separating roller 45 separates the transfer materials one by one and feeds the transfer material into a feeding path 46. The transfer material is conveyed by a conveyance roller 47, is guided to the feeding path 48 in the apparatus body 100, and hits against a registration roller pair 49 to be stopped. Alternatively, transfer materials on a bypass feed tray 51 are fed by a feed roller 50, are separated one by one by a separation roller 52 to be fed into a bypass feeding path 53, and similarly hit against the registration roller pair 49 to be stopped. Rotating the registration roller pair 49 in synchronization with the full-color image on the intermediate transfer belt 10 feeds the transfer material between the intermediate transfer belt 10 and the secondary transfer device 22. The secondary transfer device 22 transfers the full-color toner image onto the transfer material.

The transfer material onto which the full-color toner image has been transferred is conveyed by the secondary transfer device 22 to the fixing device 25. The fixing device 25 applies heat and pressure to the transfer material to fix the full-color toner image on the transfer material. A switching claw 55 is switched to eject the transfer material by an output roller pair 56 and stack the transfer material onto an output tray 57. Alternatively, the switching claw 55 is switched to feed the transfer material to the reversing device 28. The transfer material is reversed in the reversing device 28 and fed again to the transfer position. After an image is formed on the opposite side of the transfer material, the transfer material is ejected onto the output tray 57 by the output roller pair 56. Thereafter, when formation of two or more images is instructed, the above-described image forming process is repeated.

After image formation is performed on a predetermined number of transfer materials, post-image-formation processing is performed, and then the rotations of the photoconductors 40Y, 40C, 40M, and 40Bk are stopped. In the post-image-formation processing, each of the photoconductors 40Y, 40C, 40M, and 40Bk is rotated more than one turn, with the charging bias and the transfer bias turned off. The charge remover removes charges from the surface of the photoconductors 40Y, 40C, 40M, and 40Bk to prevent the photoconductors 40Y, 40C, 40M, and 40Bk from being left charged, thus preventing degradation.

When the black-and-white mode is selected, the support roller 15 moves downward to separate the intermediate transfer belt 10 from the photoconductors 40Y, 40C, 40M, and 40Bk. Only the photoconductor 40Bk for Bk color rotates in the counterclockwise direction in FIG. 1 and the surface of the photoconductor 40Bk is uniformly charged by the charging roller 18Bk. Laser light corresponding to an image of Bk color is irradiated to form a latent image, and the latent image is developed with the Bk toner to form a toner image. The toner image is transferred onto the intermediate transfer belt 10. At that time, the photoconductors 40Y, 40C, and 40M other than the photoconductor 40Bk and the developing devices 60Y, 60C, and 60M other than the developing device 60Bk are stopped to prevent unnecessary wearing of the photoconductors and the developing devices.

On the other hand, the transfer material is fed from the sheet feed cassette 44 and conveyed by the registration roller pair 49 at a timing coinciding with the toner image formed on the intermediate transfer belt 10. The transfer material on which the toner image has been transferred is fixed by the fixing device 25 as in the case of the full-color image and is processed through an output system according to a designated mode. Thereafter, when formation of two or more images is instructed, the above-described image forming process is repeated.

Figure 2:
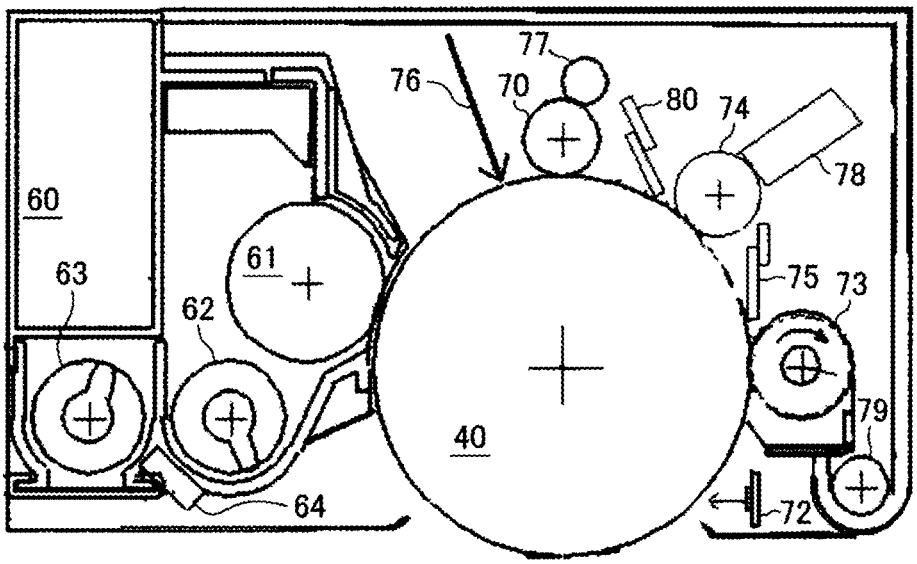
FIG. 2 is a schematic view of an image forming unit.

FIG. 2 illustrates the configuration of the image forming unit. An opening through which exposure light 76 from the exposure device 21 passes is provided around the photoconductor 40 serving as an image bearer. A charging roller 70 as a charger to uniformly charge the photoconductor 40, the developing device 60 to develop an electrostatic latent image formed on the photoconductor 40, the charge removing lamp 72 to remove charge from the surface of the photoconductor 40 after a toner image is transferred, and a brush roller 73 and a cleaning blade 75 to remove untransferred residual toner are arranged around the photoconductor 40.

A brush roller 74 is disposed downstream of the brush roller 73 and the cleaning blade 75 in the direction of rotation of the photoconductor 40. A solid lubricant 78 is in contact with the brush roller 74. The lubricant 78 is scraped off by the brush roller 74 and is applied to the photoconductor 40 by an application blade 80. Examples of the solid lubricant 78 include fatty acid metal salts such as zinc stearate and zinc palmitate, natural waxes such as carnauba wax, and fluorine-based resins such as polytetrafluoroethylene. If necessary, other materials may be mixed. The solid lubricant can be produced by melting and solidifying lubricant particles or by compression molding.

The toner scraped from the photoconductor by the brush roller or the cleaning blade made of polyurethane rubber is collected by a toner conveying coil 79 and conveyed to a waste toner storage portion.

In the present embodiment, the photoconductor whose charge has been removed after the transfer is cleaned. However, in some embodiments, charge removal may be performed on the photoconductor having been cleaned after the transfer.

Figure 3:
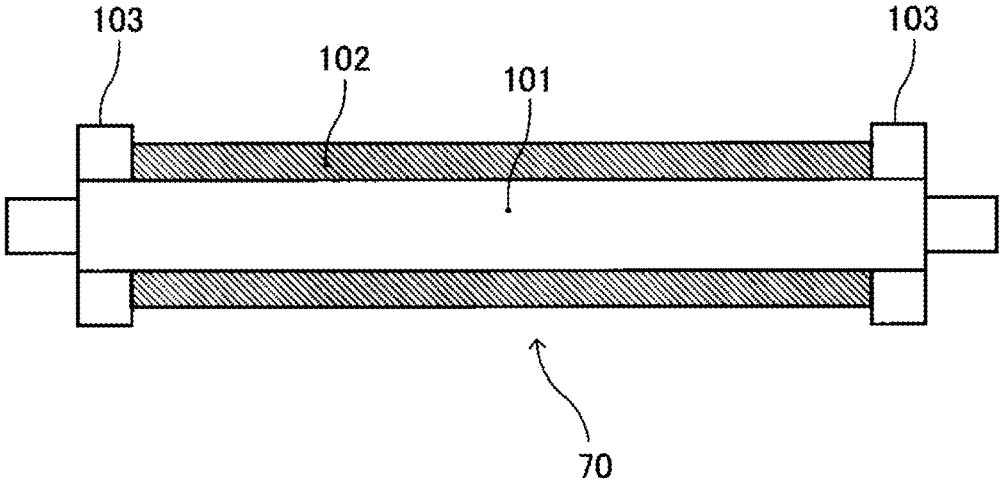
FIG. 3 is a schematic view of a configuration example of a charging roller.

FIG. 3 illustrates a configuration of the charging roller 70 usable in the present embodiment. The charging roller 70 includes a core metal 101 as a conductive support, a resin layer 102, and a gap retainer 103. The core metal is made of metal such as stainless steel. If the core metal 101 is too thin, the influence of deflection at the time of cutting the resin layer 102 or when the photoconductor 40 is pressed cannot be ignored, thus hampering necessary gap accuracy from being achieved. If the core metal 101 is too thick, the charging roller 70 is increased in size or mass. Therefore, the diameter of the core metal 101 is preferably about 6 to about 10 mm.

The resin layer of the charging roller 70 is preferably made of a material having a volume resistance of $10^4$ to $10^9$ Ωcm. If the resistance is too low, leakage of the charging bias is likely to occur when there is a defect such as a pinhole in the photoconductor 40. If the resistance is too high, discharge is not sufficiently generated and a uniform charge potential is obtained. A desired volume resistance can be obtained by blending a conductive material with a resin as a base material. Examples of the base resin include resins such as polyethylene, polypropylene, polymethyl methacrylate, polystyrene, acrylonitrile-butadiene-styrene copolymer, and polycarbonate. Such base resins have good moldability and therefore can be easily molded.

The conductive material is preferably an ion-conductive material such as a polymer compound having a fourth ammonium base. Examples of the polyolefin having a fourth ammonium base include polyolefins having a fourth ammonium base, such as polyethylene, polypropylene, polybutene, polyisoprene, ethylene-ethyl acrylate copolymer, ethylene-methyl acrylate copolymer, ethylene-vinyl acetate copolymer, ethylene-propylene copolymer, and ethylene-hexene copolymer. In the present embodiment, the polyolefin having a fourth ammonium base is exemplified. However, in some embodiments, a polymer compound other than the polyolefin having a fourth ammonium base may be used.

The ion-conductive material is uniformly mixed with the above-described base resin by means of a two-shaft kneader, a kneader, or the like. The compounded material is injection-molded or extrusion-molded on a core metal to easily mold the material into a roller shape. The blending amount of the ion-conductive material and the base resin is preferably 30 to 80 parts by weight with respect to 100 parts by weight of the base resin. The thickness of the resin layer of the charging roller 70 is preferably 0.5 to 3 mm. If the resin layer is too thin, molding is difficult and there is a problem in strength. If the thickness of the resin layer is too large, the charging roller 70 is increased in size and the actual resistance of the resin layer is increased, resulting in a decrease in charging efficiency.

After the resin layer 102 is formed, the gap retainers 103 formed in advance at both ends of the resin layer 102 are fixed to the core metal 101 by press-fitting, bonding, or both. In this manner, after the resin layer 102 and the gap retainers 103 are integrated with each other, the outer diameter of the charging roller 70 is adjusted by performing processing such as cutting or grinding, so that the phase of the deflection of the resin layer 102 and the phase of the deflection of the gap retainer 103 can be aligned with each other, and the variations of the charging gap can be reduced.

As the material of the gap retainer 103, a resin such as polyethylene, polypropylene, polymethyl methacrylate, polystyrene, acrylonitrile-butadiene-styrene copolymer, or polycarbonate can be used similarly to the base material of the resin layer 102. However, since the gap retainer 103 is brought into contact with the photoconductive layer, it is desirable to use a grade having a hardness lower than the hardness of the resin layer 102 in order to prevent the photoconductive layer from being damaged. In addition, as a resin material having excellent sliding properties and hardly damaging the photoconductive layer, resins such as polyacetal, ethylene-ethyl acrylate copolymer, polyvinylidene fluoride, tetrafluoroethylene-perfluoroalkyl vinyl ether copolymer, and tetrafluoroethylene-hexafluoropropylene copolymer can also be used.

The resin layer 102 and the gap retainer 103 may be coated with a surface layer having a thickness of about several tens of micrometers to which toner or the like does not easily adhere. The gap retainer 103 is brought into contact with the outside of the image area of the photoconductor 40 to form a gap between the resin layer 102 of the charging roller 70 and the photoconductor 40. In the charging roller 70, a gear attached to an end portion of the core metal is engaged with a gear formed on a photoconductor flange. When the photoconductor 40 is rotated by a photoconductor driving motor, the charging roller 70 is also rotated in the following direction. The resin layer 102 and the photoconductor 40 do not come into contact with each other. Therefore, even when a hard resin material and an organic photoconductor are used as the charging roller 70 and the photoconductor 40, respectively, the photoconductive layer in the image area is not damaged. Further, if the gap is too wide, abnormal discharge occurs and uniform charging cannot be performed, so that the maximum gap needs to be restrained to about 100 μm or less. In the case of using such a charging roller with a gap between the photoconductor and the charging roller, it is desirable to use a charging bias in which an alternating current (AC) voltage is superimposed on a DC voltage.

The resin layer 102 and the gap retainer 103 are made of resin materials, thus allowing a charging roller to be easily processed and have high accuracy. A cleaning roller 77 is in contact with the charging roller 70 to clean the surface of the charging roller 70. The cleaning roller 77 is a roller in which a melamine foam is attached to a core metal, and is in contact with the charging roller 70 by its own weight, and removes dirt such as toner adhering to the surface of the charging roller 70 while rotating in accordance with the rotation of the charging roller 70. The cleaning roller 77 may be constantly kept in contact with the charging roller 70. However, in some embodiments, a contact-and-separation mechanism for the cleaning roller 77 may be provided so that the cleaning roller 77 is usually separated from the charging roller 70 and is periodically brought into contact with the charging roller 70 as necessary to intermittently clean the surface of the charging roller 70. Although the charging roller 70 described above includes the gap retainer 103 to bring the surface of the photoconductor 40 and the resin layer 102 of the charging roller 70 close to each other, the charging roller 70 that brings the resin layer 102 into contact with the surface of the photoconductor 40 may be used.

Each of the developing devices 60Y, 60C, 60M, and 60Bk has the same configuration and is a developing device of a two component developing system in which only the color of the toner to be used is different, and a two component developer composed of toner and carrier is accommodated in the developing device of each color.

The developing device 60 includes a developing roller 61 facing the photoconductor 40, screws 62 and 63 to convey and stir the developer, and a toner concentration sensor 64. The developing roller 61 includes an outer rotatable sleeve and an inner fixed magnet. A necessary amount of toner is supplied from a toner supply device in accordance with the output of the toner concentration sensor 64.

The toner contains a binder resin, a colorant, and a charge control agent as main components, and other additives are added as necessary. Specific examples of the binder resin include polystyrene, a styrene-acrylic acid ester copolymer, and a polyester resin. As colorants (for example, yellow, magenta, cyan, and black) used in the toner, colorants known for toners can be used. The amount of the colorant is preferably from 0.1 to 15 parts by weight per 100 parts by weight of the binder resin.

Specific examples of a charge control agent include a nigrosine dye, a chromium-containing complex, and a fourth class ammonium salt, which are selectively used depending on the polarity of toner particles. The amount of the charge control agent is 0.1 to 10 parts by weight based on 100 parts by weight of the binder resin.

It is advantageous to add a fluidity imparting agent to the toner particles. Examples of the fluidity imparting agent include fine particles of metal oxides such as silica, titania and alumina, fine particles obtained by surface-treating such fine particles with a silane coupling agent, a titanate coupling agent or the like, and fine particles of polymers such as polystyrene, polymethyl methacrylate and polyvinylidene fluoride. The particle diameter of the fluidity imparting agent is in the range of 0.01 to 3 μm. The addition amount of the fluidity imparting agent is preferably in the range of 0.1 to 7.0 parts by weight with respect to 100 parts by weight of the toner particles.

The carrier is generally composed of a core material itself or a core material provided with a coating layer. The core material of the resin-coated carrier that can be used in the present embodiment is ferrite or magnetite. The particle diameter of the core material is suitably about 20 to 60 μm.

Examples of the material used to form the carrier coating layer include vinylidene fluoride, tetrafluoroethylene, hexafluoropropylene, perfluoroalkyl vinyl ether, vinyl ether substituted with a fluorine atom, and vinyl ketone substituted with a fluorine atom. As a method of forming the coating layer, the resin may be applied to the surfaces of the carrier core particles by means of a spraying method, a dipping method or the like as in a conventional method.

Figure 4A:
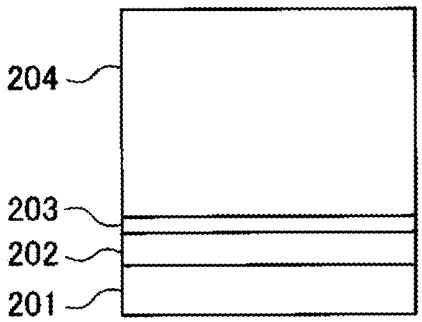
FIGS. 4A and 4B are schematic views of configuration examples of a photoconductor.

FIG. 4 illustrates a configuration of the photoconductor 40 usable in the present embodiment. As an example of the photoconductor 40 used in the present embodiment, a description is given of a laminated organic photoconductor including a charge generation layer 203 and a charge transport layer 204, which are photoconductive layers formed on a conductive support 201. The conductive support 201 is made of a material exhibiting conductivity with a volume resistance of $10^{10}$ Ωcm or less, for example, a material obtained by surface-treating a tube material of aluminum, an aluminum alloy, nickel, stainless steel, or the like by cutting, polishing, or the like. The charge generation layer 203 is a layer containing a charge generation material as a main component.

As the charge generating material, an inorganic or organic material is used, and typical examples thereof include monoazo pigments, disazo pigments, trisazo pigments, perylene pigments, perinone pigments, quinacridone pigments, quinone condensed polycyclic compounds, squaric acid dyes, phthalocyanine pigments, naphthalocyanine pigments, azulenium salt dyes, selenium, selenium-tellurium alloys, selenium-arsenic alloys, amorphous silicon, and the like. Such charge generating materials may be used alone or in combination of two or more.

The charge generation layer 203 can be formed by dispersing the charge generation material together with an appropriate binder resin in a solvent such as tetrahydrofuran, cyclohexanone, dioxane, 2-butanone, or dichloroethane using a ball mill, an attritor, a sand mill, or the like, and applying the dispersion. The application of the charge generation layer can be performed by a dip coating method, a spray coating method, a bead coating method, or the like.

Examples of the binder resin that is appropriately used include resins such as polyamide, polyurethane, polyester, epoxy, polyketone, polycarbonate, silicone, acrylic, polyvinyl butyral, polyvinyl formal, polyvinyl ketone, polystyrene, polyacrylic, and polyamide. The amount of the binder resin is suitably from 0 to 2 parts by weight based on 1 part of the charge generating material.

The thickness of the charge generation layer 203 is usually 0.01 to 5 μm, and preferably 0.1 to 2 μm. The charge transport layer 204 can be formed by dissolving or dispersing a charge transport material and a binder resin in an appropriate solvent, and applying and drying the resultant. The charge transport layer 204 may further include a plasticizer and/or a leveling agent.

Among the charge transport materials, low molecular weight charge transport materials include electron-transport materials and hole transport materials. Examples of the electron-transport material include electron-accepting substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, and 1,3,7-trinitrodibenzothiophene-5,5-dioxide.

Such electron-transport materials may be used alone or as a mixture of two or more thereof. Examples of the hole transport material include electron donating substances such as oxazole derivatives, oxadiazole derivatives, imidazole derivatives, triphenylamine derivatives, 9-(p-diethylaminostyrylanthracene), 1,1-bis-(4-dibenzylaminophenyl) propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. Such hole transport materials may be used alone or as a mixture of two or more thereof.

Examples of the binder resin used in the charge transport layer together with the charge transport material include thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy, polycarbonate, cellulose acetate, ethyl cellulose, polyvinyl butyral, polyvinyl formal, polyvinyl toluene, acrylic, silicone, epoxy, melamine, urethane, phenol, and alkyd.

Examples of the solvent include tetrahydrofuran, dioxane, toluene, 2-butanone, monochlorobenzene, dichloroethane, and methylene chloride.

The thickness of the charge transport layer 204 may be appropriately selected from the range of 10 to 40 μm in accordance with desired photoconductor characteristics.

In the photoconductor 40 of the present embodiment, an undercoat layer 202 may be formed between the conductive support 201 and the photoconductive layer. The undercoat layer 202 generally contains a resin as a main component. Considering that the photoconductive layer is coated on the resin using a solvent, the resin is desirably a resin having high solubility resistance to a general organic solvent. Examples of such a resin include water-soluble resins such as polyvinyl alcohol, casein, and sodium polyacrylate; alcohol-soluble resins such as copolymerized nylon and methoxymethylated nylon; and curable resins forming a three-dimensional network structure such as polyurethane, melamine, alkyd-melamine, and epoxy.

In addition, fine powder of a metal oxide such as titanium oxide, silica, alumina, zirconium oxide, tin oxide, or indium oxide may be added to the undercoat layer 202 in order to prevent moire and reduce residual potential. The undercoat layer 202 can be formed by using an appropriate solvent and coating method in the same manner as the photoconductive layer. Further, as the undercoat layer 202, it is also useful to use a metal oxide layer formed by, for example, a sol-gel method using a silane coupling agent, a titanium coupling agent, a chromium coupling agent, or the like. In addition, as the undercoat layer 202, a layer formed by anodizing $Al_2O_3$, a layer formed by forming an organic substance such as polyparaxylylene (parylene) or an inorganic substance such as SiO, $SnO_2$, $TiO_2$, ITO, or $CeO_2$ by a vacuum thin film forming method is also effective. The thickness of the undercoat layer 202 is suitably 0 to 5 μm.

Figure 4B:
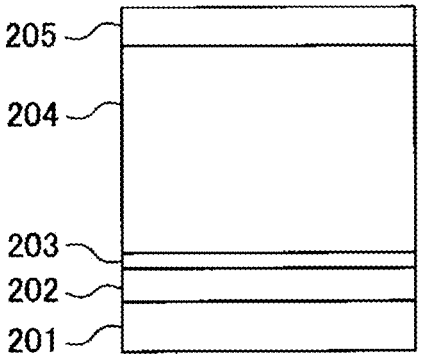

As illustrated in FIG. 4B, a protective layer 205 may be formed on the photoconductive layer of the photoconductor 40 of the present embodiment in order to protect the photoconductive layer and enhance durability. The protective layer 205 is formed by adding fine particles of a metal oxide such as alumina, silica, titanium oxide, tin oxide, zirconium oxide, or indium oxide to a binder resin for the purpose of enhancing abrasion resistance. Examples of the binder resin include resins such as styrene-acrylonitrile copolymer, styrene-butadiene copolymer, acrylonitrile-butadiene-styrene copolymer, olefin-vinyl monomer copolymer, chlorinated polyether, allyl, phenol, polyacetal, polyamide, polyamide-imide, polyacrylate, polyallylsulfone, polybutylene, polybutylene terephthalate, polycarbonate, polyether sulfone, polyethylene, polyethylene terephthalate, polyimide, acrylic, polymethylpentene, polypropylene, polyphenylene oxide, polysulfone, polyurethane, polyvinyl chloride, polyvinylidene chloride, and epoxy.

The amount of the metal oxide fine particles added to the protective layer 205 is usually 5 to 30% by weight. When the amount of the metal oxide fine particles is less than 5%, the abrasion is large, the effect of enhancing the abrasion resistance is small, and the durability is poor. When the amount of the metal oxide fine particles exceeds 30%, the increase of the bright portion potential at the time of exposure becomes remarkable, and the decrease in sensitivity cannot be ignored, which is not desirable. As a method of forming the protective layer 205, an ordinary coating method such as a spray method is adopted. The thickness of the protective layer 205 is suitably about 1 to 10 μm, and preferably about 3 to 8 μm. If the thickness of the protective layer 205 is too small, the durability is poor. If the thickness of the protective layer 205 is too large, not only the productivity at the time of manufacturing the photoconductor is lowered, but also the increase in residual potential with time becomes large. The particle diameter of the metal oxide particles added to the protective layer 205 is suitably 0.1 to 0.8 μm. If the particle size of the metal oxide fine particles is too large, the surface of the protective layer becomes rough and the cleaning property is lowered. In addition, the exposure light is easily scattered by the protective layer, the resolving power is lowered, and the image quality is deteriorated. If the particle size of the metal oxide fine particles is too small, the wear resistance is poor.

Further, a dispersion aid may be added to the protective layer 205 in order to enhance the dispersibility of the metal oxide fine particles in the base resin. As the dispersion aid to be added, a dispersion aid used in paint and the like can be appropriately used. The amount of the dispersion aid is usually 0.5 to 4%, preferably 1 to 2%, on a weight basis with respect to the amount of the metal oxide fine particles contained. In addition, adding a charge transport material to the protective layer 205 can promote charge transfer in the protective layer 205. As the charge transport material added to the protective layer, the same material as the charge transport layer can be used.

Figure 5:
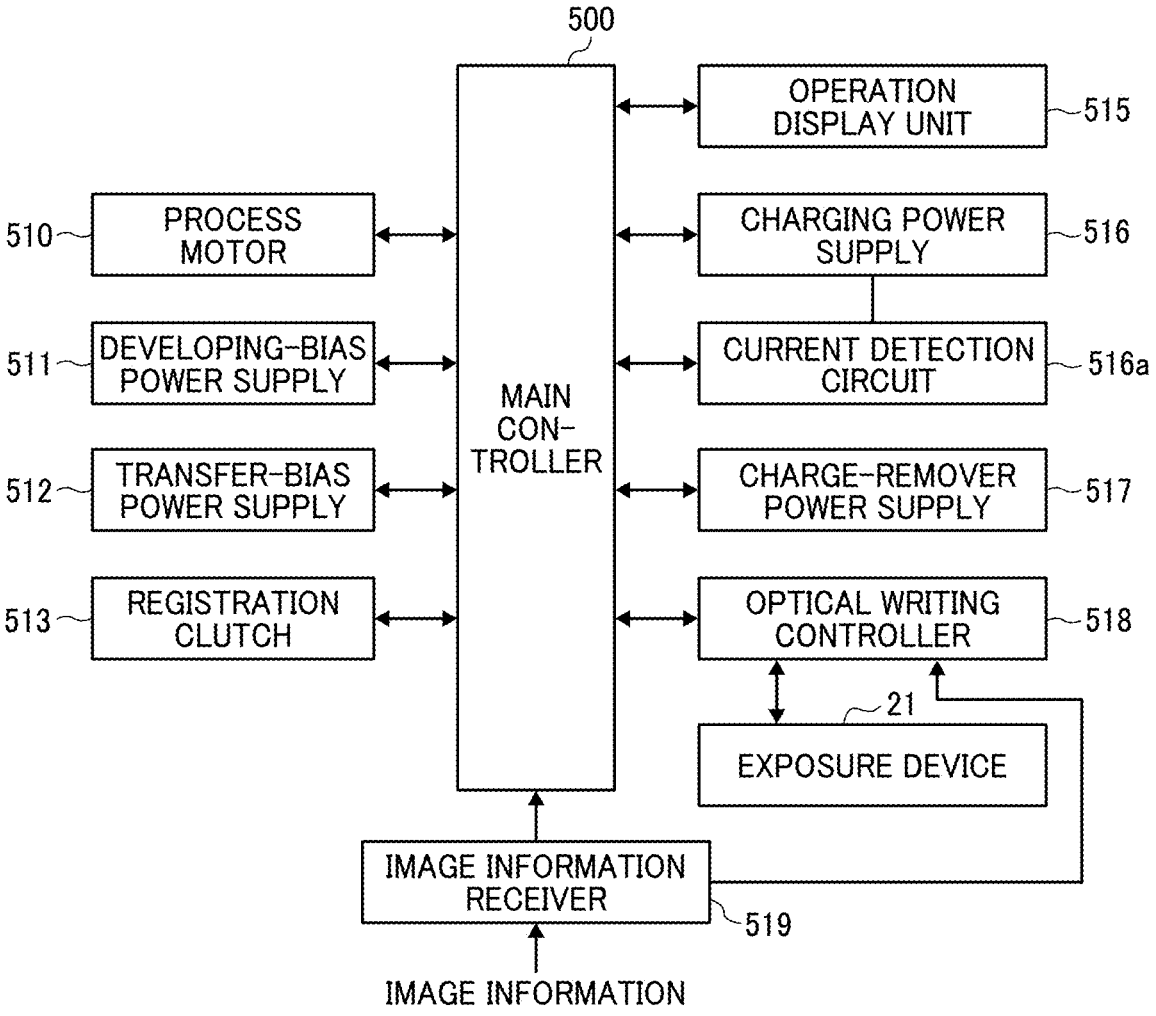
FIG. 5 is a block diagram illustrating a part of an electric circuit of a full-color copier.

FIG. 5 is a block diagram illustrating a part of an electric circuit of the full-color copier according to an embodiment of the present disclosure. Referring to FIG. 5, a main controller 500 as control circuitry controls driving of each device of the full-color copier, and includes a central processing unit (CPU), a random access memory (RAM) serving as a data storage device, a read only memory (ROM) serving as a data storage device, and the like. Based on the programs stored in the ROM, the CPU controls the driving of various devices and executes predetermined arithmetic processing.

A process motor 510, a developing-bias power supply 511, a transfer-bias power supply 512, a registration clutch 513, and the like are connected to the main controller 500. In addition, an operation display unit 515, a charging power supply 516 to apply a voltage to the charging roller 70, a charge-remover power supply 517 for the charge removing lamp 72, an optical writing controller 518, an image information receiver 519, and the like are also connected to the main controller 500.

The image information receiver 519 receives image information sent from the scanner 300 and sends the image information to the main controller 500 and the optical writing controller 518. The optical writing controller 518 controls driving of the exposure device 21 based on the image information sent from the image information receiver 519, thereby optically scanning the surface of the photoconductor 40.

The process motor 510 is a motor serving as a driving source for the photoconductor 40, the developing device 60, various rollers, and the like. The rotational driving force of the process motor 510 is transmitted to the registration roller pair 49 via the registration clutch 513. The main controller 500 turns on the registration clutch 513 at a predetermined timing to connect the rotational driving force of the process motor 510 to the registration roller pair 49.

The developing-bias power supply 511 applies, to the developing roller 61, a developing bias having the same polarity as a polarity of the toner and having an absolute value larger than the absolute value of the latent image potential VL and smaller than the charge potential VD of the background portion of the photoconductor 40. For example, the developing bias of −550 V is applied under the conditions of the photoconductor surface potential −600 V and the electrostatic latent image potential=−30 V. The main controller 500 sends an output command signal to the developing-bias power supply 511 to cause the developing-bias power supply 511 to output the developing bias at a predetermined timing.

Further, the main controller 500 sends an output command signal to the transfer-bias power supply 512 at a predetermined timing, thereby causing the transfer-bias power supply 512 to output the transfer bias. The transfer bias is a voltage for forming a transfer electric field between the intermediate transfer belt 10 and the electrostatic latent image on the photoconductor 40 at a transfer portion where a transfer device including the transfer roller 82, the conveyance belt unit, and the like faces the photoconductor 40.

The operation display unit 515 includes a touch panel, a numeric keypad, and the like, and displays an image on the touch panel and transmits information input by the touch panel, the numeric keypad, and the like to the main controller 500.

The charging power supply 516 applies a charging bias obtained by superimposing an alternating current AC on a direct current DC to the charging roller 70, and detects a DC component (hereinafter, referred to as a DC charging current) of a charging current flowing through the charging roller 70. For this purpose, the charging power supply 516 is provided with a current detection circuit **516*a* that detects a current during charging, and an output of the current detection circuit 516*a* is sent to the main controller 500. Instead of or in addition to the charging power supply 516, a current measuring circuit may also be provided to detect a current flowing through the base of the photoconductor 40 and send the output of the current measuring circuit to the main controller 500. The current detection circuit 516*a* may be built in the charging power supply 516**.

As will be described later, the main controller 500 functions as an estimation device that estimates the charge potential of the photoconductor. The main controller 500 functions as a control device that controls the charging power supply 516 to control the charging bias applied to the charging roller.

The thickness of the photoconductive layer of the photoconductor 40 described above is generally about 3 to 5 μm for the undercoat layer 202, about 0.1 to 1.0 μm for the charge generation layer 203, about 3 to 40 μm for the charge transport layer 204, and about 25 to 5 μm for the protective layer 205. The photoconductor 40 has a film thickness variation of several micrometers in manufacturing, and the capacitance varies. In addition, since the outermost layer is worn by friction with a cleaning blade or the like, the capacitance changes due to the wear of the photoconductive layer when used for a long period of time. Further, due to the fatigue of the photoconductor, a larger amount of current is necessary to eliminate the trap in the photoconductor. Even under this influence, the charging bias for obtaining the target charge potential is different.

Therefore, in the present embodiment, the surface potential of the photoconductor is estimated, and the charging DC bias for obtaining the target charge potential is calculated based on the estimated surface potential of the photoconductor. Calculation of the estimated value of the surface potential of the photoconductor will be described below.

Figure 6:
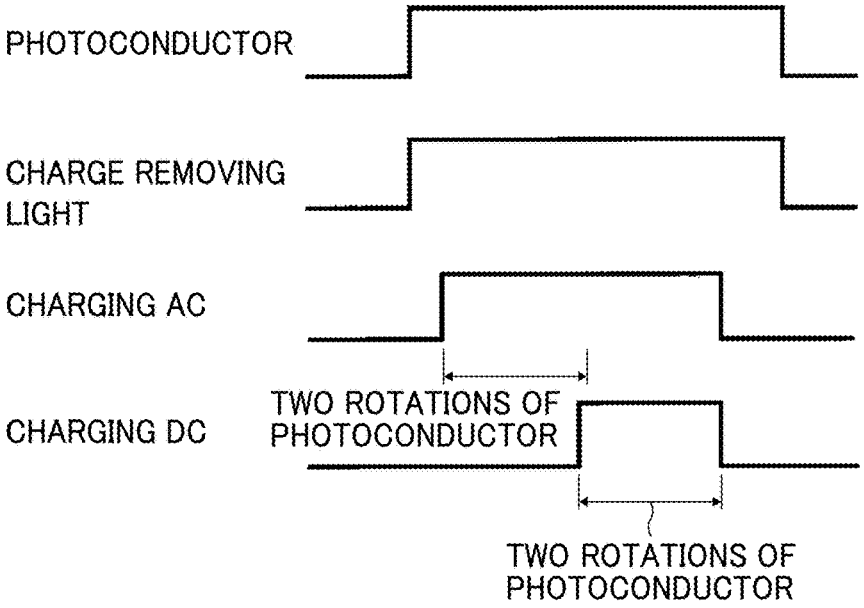
FIG. 6 is a timing chart illustrating an acquisition operation of a direct current (DC) charging current value.

Acquisition of DC Charging Current Value for Estimating Surface Potential of Photoconductor FIG. 6 is a timing chart of an operation of acquiring a DC charging current value. First, the main controller 500 rotates the photoconductor 40 and turns on the charge removing lamp 72. When the photoconductor 40 reaches a predetermined rotation speed, a charging AC bias is applied from the charging power supply 516 to the charging roller 70. As a result, charge on the photoconductor 40 is removed by the charge removing light of the charge removing lamp 72 and the discharge of the charging roller 70. That is, in the present embodiment, the charge removing lamp 72 and the charging roller 70 function as charge remover.

After charge is removed from the entire surface of the photoconductor 40 by rotating the photoconductor 40 more turns, a predetermined charging DC bias (for example, 700 V) is applied to the charging roller 70 from the charging power supply 516 until the photoconductor 40 makes one turn, and the DC charging current at this time is detected. The image forming apparatus includes a transfer device. However, a transfer bias is not applied when the DC charging current is detected because the transfer bias may disturb the relationship between the photoconductor potential and the DC charging current. The detected DC charging current is stored in a memory.

Further, the photoconductor 40 is rotated once more, and the DC charging current during the rotation of the photoconductor 40 is detected. From the DC charging current value at the time of the second rotation of the photoconductor 40 and the DC charging current value at the time of the first rotation, the residual potential of the photoconductor 40 remaining without being removed only by the charge removing light of the charge removing lamp 72 can be obtained.

Figure 7:
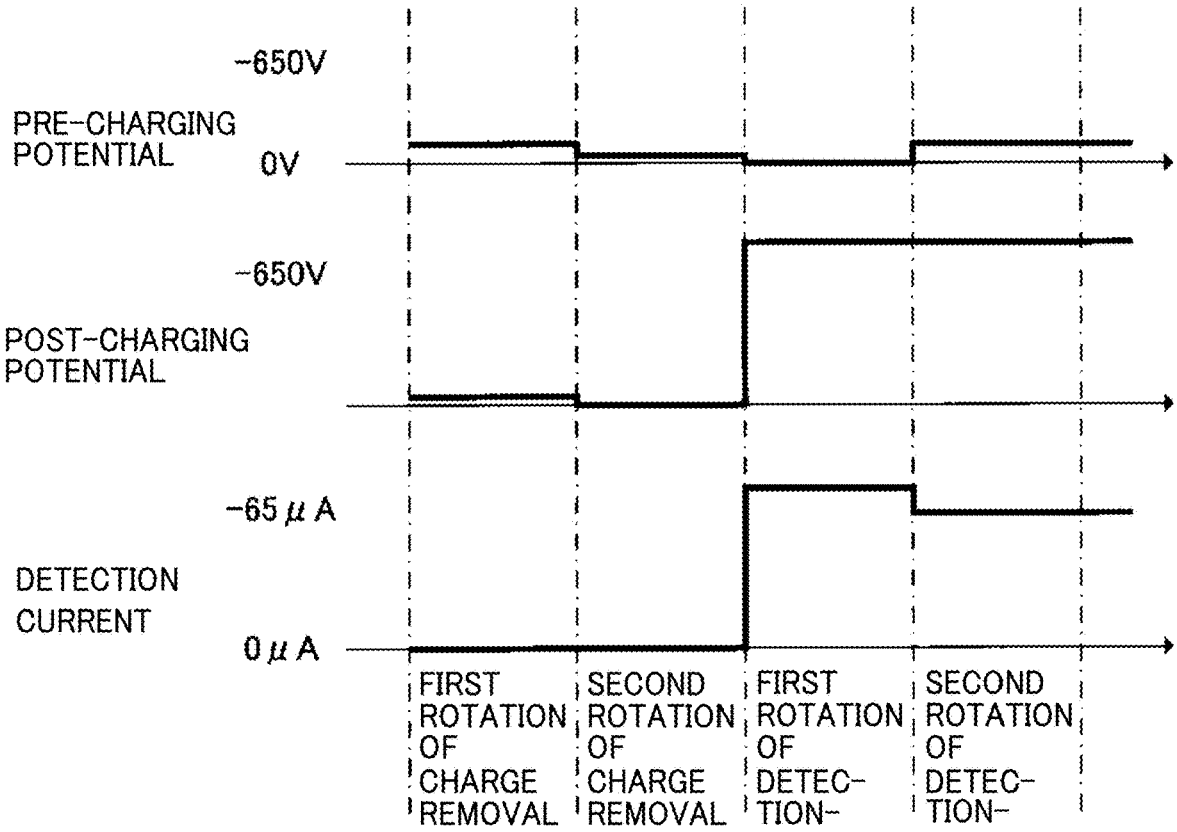
FIG. 7 is a graph illustrating the relationship between the potential of the photoconductor after passing through a charge removing lamp and before passing through the charging roller during the acquisition operation of the DC charging current, the potential of the photoconductor after passing through the charging roller, and the DC charging current.

Relationship Between Photoconductor Potential and Detection Current Before and After Charging During DC Charging Current Acquisition Operation FIG. 7 is a diagram illustrating the relationships between the photoconductor potential (pre-charging potential) after passing through the charge removing lamp 72 and before passing through the charging roller 70 during the DC charging current obtaining operation, the photoconductor potential (post-charging potential) after passing through the charging roller 70, and the DC charging current. FIG. 7 illustrates the relationships when the photoconductor 40 with advanced fatigue is used. As illustrated in FIG. 7, in the first rotation of the charge removal, the potential of the photoconductor 40 after the charge removal by the light of the charge removing lamp (pre-charging potential) is 0 V or more, and there is a residual potential. After the charging AC is applied to the charging roller 70 and charge removal is performed by discharging the charging roller 70, the potential (post-charging potential) of the photoconductor is closer to 0 V. The role of the charge-removing operation by discharging the charging AC is to promote the movement of the holes in the photoconductor 40 as described above, Therefore, the charging DC bias is not applied (0 V), and the DC current detection circuit is configured to detect the current on the polarity side to charge the photoconductor 40. Accordingly, the DC charging current (detection current) is 0 μA and is not measured.

Since the transfer bias is turned off during the operation of estimating the charge potential, the surface of the photoconductor 40 passes through the charge removing lamp 72 with the post-charging potential in the first rotation for charge removal being maintained. Although the surface of the photoconductor 40 is irradiated with light from the charge removing lamp 72 also in the second rotation for charge removal, charges on the surface of the photoconductor 40 are hardly removed by charge removal with the light of the charge removing lamp 72. The pre-charging potential after passing through the charge removing lamp 72 is substantially the post-charging potential in the first rotation for charge removal. When the surface of the photoconductor 40 passes through the charging roller 70, the surface of the photoconductor 40 receives the charging AC again, so that the charges are further removed by the discharge. The surface potential (post-charging potential) of the photoconductor 40 after passing through the charging roller 70 further approaches 0 V. Also in this case, the charging DC bias is not applied (0 V). The DC charging current (detection current) is 0 μA and is not measured.

Although FIG. 7 illustrates the case where the photoconductor 40 with advanced fatigue is used, there is also a case where the potential of the photoconductor 40 becomes substantially 0 V due to the charge removal by the discharge of the charging AC in the first rotation while the photoconductor 40 is relatively new. Therefore, for example, when the photoconductor 40 is relatively new, the number of rotations of the photoconductor 40 in the charge removing operation may be one. When the photoconductor 40 is used for a predetermined period of time, the number of rotations of the photoconductor 40 in the charge removing operation may be two. Such a configuration can shorten the operation of estimating the charge potential at the initial stage of use of the photoconductor. Since it is difficult to accurately estimate the fatigue state of the photoconductor, the number of rotations of the photoconductor in the charge removing operation may be two from the initial stage of use of the photoconductor.

In the present embodiment, charges on the photoconductor 40 are removed by a combination of charge removal by the charge removing light and discharging of the charging AC bias. This is because the residual potential remains on the photoconductor 40 in the charge removal only by the charge removing light and the residual potential varies depending on the use environment and the fatigue state of the photoconductor 40. Combining the charge removal by the charge removing light and the charge removal by the discharge of the charging AC bias allows the potential of the photoconductor after the charge removal to approach substantially 0 V regardless of the use environment or the fatigue state of the photoconductor 40. As described above, since the photoconductor potential after the charge removing operation, that is, before detection of the DC charging current is 0 V, the accuracy of estimating the charge potential of the photoconductor 40 can be enhanced by multiplying the detected charging current by a capacitance coefficient as a characteristic value of the photoconductor described later.

This is because, as the charge potential of the photoconductor 40 is lowered, the electric field applied to the photoconductive layer is reduced, thus hampering movement of the holes generated in the charge generation layer (CGL). On the other hand, it is considered that using both the charge removing light and the charging AC bias allows the holes to be moved by the electric field of the charging AC bias and the charges on the surface of the photoconductor 40 can be removed by the discharge.

Even when the charges are removed by using both the charge removing light and the charging AC bias, the charges may not be removed to 0 V only by the rotation of the photoconductor 40 under the use conditions of the photoconductor 40, such as a state in which the residual potential is increased due to the frequent use of the photoconductor 40 or a low-temperature environment in which the moving speed of holes is decreased. Therefore, in the present embodiment, charge removal is performed on the entire surface of the photoconductor by rotating the photoconductor 40 two or more times from the application of the charging AC. As a result, the photoconductor 40 can be satisfactorily discharged to 0 V regardless of the use conditions of the photoconductor 40. In addition, in use conditions in which it is more difficult to remove the charges, such as a case where the photoconductor 40 is used in a low-temperature environment and at a high frequency, the charge removal of the photoconductor 40 may be performed three times or more and the number of times of rotation of the photoconductor 40 may be increased compared to the charge removal operation in a normal state.

When the charge removing operation of the photoconductor 40 is completed, the charge removing operation is subsequently shifted to the DC charging current detecting operation. The pre-charging potential before passing through the charging roller 70 in the DC charging current detecting operation in the first rotation of the photoconductor 40 is substantially 0 V. In addition to the charging AC bias, a charging DC bias is applied to the charging roller 70 to charge the photoconductor 40. In the example illustrated in FIG. 6, −700 V is applied to the charging roller 70 as the charging DC bias, and the photoconductor 40 is charged to about −650 V. At this time, the amount of charge necessary for charging the photoconductor 40 from 0 V to −650 V was measured as a DC charging current by the current detection circuit 516*a*. in the example illustrated in FIG. 6, a DC charging current of about −65 μA was measured. The relationship between the charge potential of the photoconductor 40 and the DC charging current varies depending on the characteristics (degree of fatigue and wear) of the photoconductor 40 used, the process speed of the image forming apparatus, and the like.

At the time of the DC charging current detecting operation, the charging AC bias is used not for charge removal but for charging, so that charges on the photoconductor 40 are removed only by the charge removing light of the charge removing lamp 72. Therefore, before passing through the charging roller 70 after charge removal of the charge removing lamp 72 in the second rotation of the detecting operation, the surface of the photoconductor 40 has a predetermined residual potential (30 V in the example of FIG. 7). Therefore, in the second rotation of the detecting operation, the surface of the photoconductor 40 passes through the charging roller 70 in a state where the residual potential is present.

Although the charge potential (post-charging potential) of the photoconductor 40 after passing through the charging roller 70 in the second rotation of the detecting operation is the same as the post-charging potential in the first rotation, the detected DC charging current is smaller than the detected DC charging current in the first rotation. This is because the photoconductor 40 is charged from 0 V in the first rotation whereas the photoconductor 40 is charged from the residual potential in the second rotation. Therefore, information on the residual potential of the photoconductor 40 can be obtained from the difference in detection current between the first rotation and the second rotation. When −700 V is applied as the charging DC bias, the photoconductor 40 is charged to about −650 V. In the example illustrated in FIG. 7, the charge amount necessary for charging the photoconductor 40 from −30 V to −650 V is measured as the DC charging current in the second rotation, and a DC charging current of about −62 μA is measured.

However, the DC charging current value cannot be converted into the potential of the photoconductor 40 only by detecting the DC charging current value. Conventionally, there is known a method in which the film thickness of a photoconductor is estimated from, for example, the charging time of the photoconductor, the rotation time of the photoconductor, or the like, and a coefficient corresponding to the capacitance of the photoconductor is multiplied by the detected DC charging current value to estimate the surface potential of the photoconductor. However, even a new photoconductor has a variation in film thickness within a tolerance, and it is difficult to estimate the film thickness of the photoconductor that has been used and worn in the image forming apparatus. Therefore, the estimation accuracy of the photoconductor potential obtained in the conventional method is low. Therefore, in the present embodiment, the characteristic value of the photoconductor is acquired in the actual apparatus, and the photoconductor potential is estimated from the acquired to characteristic value of the photoconductor and the detected DC charging current.

Acquisition of Photoconductor Characteristics

Figure 8:
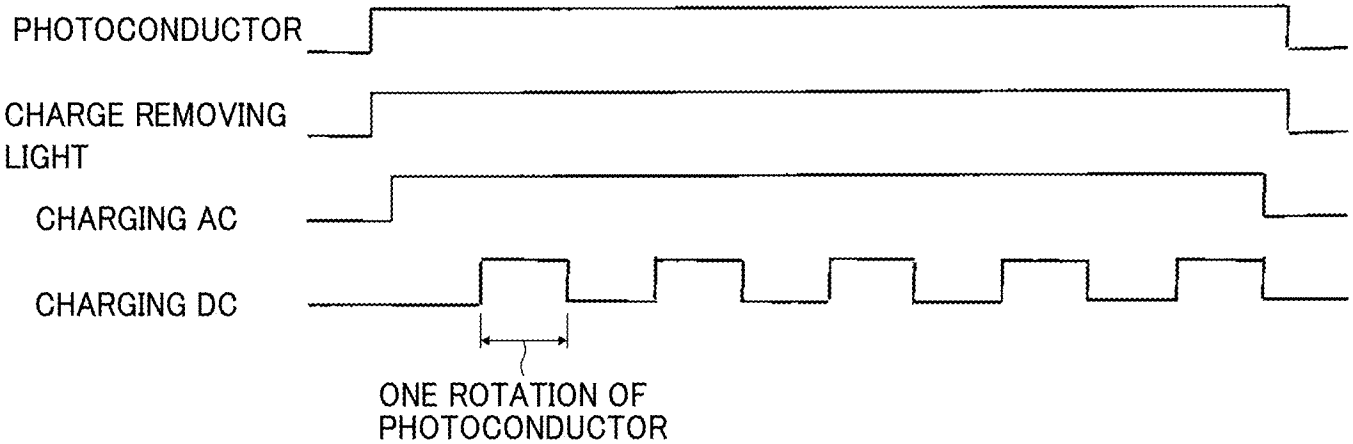
FIG. 8 is a timing chart illustrating an acquisition operation of characteristics of the photoconductor.

FIG. 8 is a timing chart of the operation of acquiring the photoconductor characteristics. First, the photoconductor 40 is rotated and the charge removing lamp 72 is turned on. When the photoconductor 40 reaches a predetermined rotation speed, a charging AC bias is applied from the charging power supply 516 to the charging roller 70, and charges on the photoconductor 40 are removed by the charge removing light and electric discharge. After the photoconductor 40 is rotated one or more times from the application of the charging AC and charge removal is performed on the entire surface of the photoconductor 40, a predetermined charging DC bias is applied from the charging power supply 516 until the photoconductor 40 rotates once, and the DC charging current at this time is detected by the current detection circuit 516*a*. This cycle of chase removal and charging is repeated by changing the value of the charging DC bias applied from the charging power supply 516. In the present embodiment, the charging DC bias uses five levels of voltages of 400 V, −500 V, −600 V, −700 V, and −800 V. The image forming apparatus includes a transfer device. However, a transfer bias is not applied when the DC charging current is detected because the transfer bias may disturb the relationship between the photoconductor potential and the DC charging current.

Since the information of the residual potential is not necessary for the acquisition of the photoconductor characteristics, the DC charging current detection in the operation of acquiring the photoconductor characteristics is performed for one rotation of the photoconductor 40 in order to shorten the operation time. In addition, the charge removal of the photoconductor 40 before the detection of the DC charging current may be performed by two or more rotations of the photoconductor 40 or may be performed by one rotation of the photoconductor 40 in order to shorten the operation time. As will be described later, the photoconductor characteristics obtained by this operation correspond to the amount of change in surface potential with respect to the amount of change in DC charging current (referred to as a capacitance coefficient). This is because the residual potential does not change greatly in a short period of time, and thus the calculation of the amount of change is not affected even in a state where the residual potential remains to some extent.

Calculation of Photoconductor Characteristics (Capacitance Coefficient)

Figure 9:
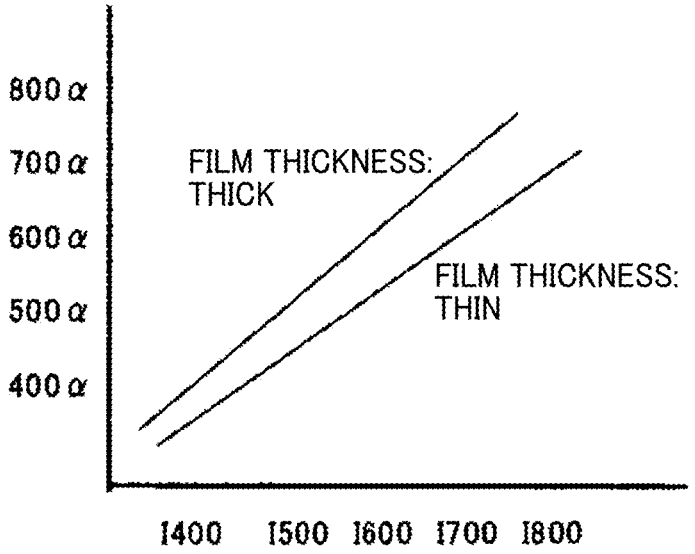
FIG. 9 is a graph plotting a detected charging current [μA] on the horizontal axis and an applied charging DC bias×α [V] on the vertical axis.

FIG. 9 plots the detected charging current [μ] on the horizontal axis and the applied charging DC bias×α[V] on the vertical axis. On the horizontal axis, for example, 1400 represents a charging current when −400 V is applied as the charging DC bias. Although the actual charge potential of the photoconductor 40 is not known, the difference between the charge potentials of the photoconductor 40 when the charging DC bias is −a V and −b V can be expressed by the following Equation 1. Difference in charge potential of the photoconductor=−(a−b)×α[V] (Equation 1)

The above-mentioned a takes a value of about 0.9 to 1.0, is determined by characteristics of the photoconductor 40 and the charging roller 70, and can be obtained in advance by an experiment. Therefore, when the slope of the plot in FIG. 9 is obtained, the amount of change in the charge potential of the photoconductor 40 with respect to the amount of change in the DC charging current can be obtained.

This slope (the amount of change in the photoconductor potential with respect to the amount of change in the DC charging current) is referred to as a capacitance coefficient [V/μA]. Since the capacitance coefficient is proportional to the reciprocal of the capacitance of the photoconductor, the smaller the thickness of the photoconductive layer, the smaller the capacitance coefficient. The capacitance coefficient reflects the variation in the film thickness of the photoconductive layer and the change in the capacitance due to the abrasion of the photoconductive layer in the case of long-term use and can be said to represent the characteristics of the photoconductor. Further, due to the fatigue of the photoconductor, a larger amount of current is necessary to eliminate the trap in the photoconductor. Even under this influence, the capacitance coefficient, which is the amount of change in the charge potential with respect to the amount of change in the charging current, is different.

The main controller 500 obtains a slope as a capacitance coefficient from the five levels of charging DC bias and the detected DC charging current value corresponding to each charging DC bias and stores the obtained slope as a capacitance coefficient in a storage device such as a memory.

Calculation of Estimated Charging Potential of Photoconductor Surface Based on Acquired DC Charging Current Value The main controller 500 calculates an estimated charge potential value from the DC charging current value acquired in the operation of acquiring the DC charging current value for estimating the surface potential of the photoconductor 40 illustrated in FIG. 6 and the capacitance coefficient acquired in the operation of acquiring the photoconductor characteristics. As an estimation formula for calculating the estimated charge potential value, the following Equation 2 can be used. Charge potential estimation value=DC charge current detection value×capacitance coefficient+β (Equation 2) Here, β is a residual potential after charge removal of the photoconductor by light and discharge and is a term for correcting the potential of the photoconductor which may not completely become zero even when charge removal is performed by light and discharge. The fact that the value does not become completely zero is considered to be due to the influence of the distortion of the AC waveform of the high-voltage power supply, and the residual potential β is determined by the performance of the high-voltage power supply. Therefore, the residual potential β can be obtained in advance by experiments.

In the present embodiment, since the potential of the photoconductor after the charge removal of the photoconductor by light and discharge, that is, the potential of the photoconductor before charging is set to approximately 0 V, the accuracy of estimating the charge potential of the photoconductor calculated from the detected DC charging current is enhanced.

The estimated residual potential value of the surface of the photoconductor can be calculated by using a difference value between the DC charging current value in the first rotation of the detecting operation and the DC charging current value in the second rotation of the detecting operation as the "DC charging current detection value" in (Equation 2). As for the DC charging current value in the first rotation, since the pre-charging potential of the photoconductor is substantially 0 V, the residual potential can be accurately estimated from the detected DC charging current value in the first rotation of the photoconductor and the detected DC charging current value in the second rotation of the photoconductor.

The main controller 500 stores the calculated charge potential estimation value and residual potential estimation value in a storage device such as a memory. Then, the charge potential estimation value calculated from the storage device at the time of image formation is read out, and the charging DC bias at the time of image formation is obtained based on the read-out charge potential estimation value. The residual potential estimation value stored in the storage device is used for image adjustment such as development potential.

Method of Obtaining Charging DC Bias at Time of Image Formation

The charging DC bias applied at the time of the operation of estimating the charge potential, the estimated charge potential of the photoconductor calculated by Equation 2, and the coefficient α are stored in the storage device. At the time of image formation, the main controller 500 calculates the charging DC bias to be applied to the charging roller 70 from the charging DC bias stored in the storage device, the estimated charge potential of the photoconductor calculated by Equation 2, the coefficient α, and the target value of the charge potential at the time of image formation. The charging DC bias Vd applied to the charging roller 70 at the time of image formation is obtained as follows, where Vd1 is the charging DC bias applied at the time of the operation of estimating the charge potential, Vy is the estimated value of the charge potential, and Vt is the target value of the charge potential at the time of image formation. That is, (Vd1−Vd)×α=(Vy−Vt) (Equation 3) is obtained from the relationship between the charging DC bias and the charge potential of the photoconductor represented by Equation 1. Therefore, Vd=[(Vy−Vt)/α]−Vd1 (Equation 4).

For example, when the charging DC bias Vd1 applied at the time of the operation of estimating the charge potential is −700V, the estimated value Vy of the charge potential at the time of application of −700V is −675 V, and the target value Vt of the charge potential at the time of image formation is −600 V, the charging DC bias Vd applied to the charging roller 70 at the time of image formation is obtained as follows. That is, the charging DC bias Vd is Vd=(75/α)−700 V from the relationship of (−700−Vd)×α=−(675−600)=−75. The estimated value Vy of the charge potential being −675 V is a value calculated from the DC charging current value detected when the charging DC bias Vd1=−700 V is applied, the capacitance coefficient acquired by the operation of acquiring the photoconductor characteristics, and the above-described Equation 2.

At the time of image formation, the main controller 500 controls the charging power supply 516 so as to obtain the calculated charging DC bias.

Image Quality Adjustment Based on Estimated Value of Residual Potential

The main controller 500 adjusts the developing bias applied to the developing roller and the exposure amount based on the estimated value of the residual potential stored in the storage device. In addition, image forming conditions such as the target value Vt of the charge potential at the time of image formation are adjusted. By adjusting the target value Vt, the DC charging bias during image formation is also adjusted. Conventionally, a potential sensor for detecting the surface potential of the photoconductor would be provided between the charge removing lamp 72 and the charging roller 70 in the movement of the photoconductor surface or between the exposure and the development, and the residual potential and the charge potential of the photoconductor are detected by the potential sensor to adjust the image forming conditions such as the developing bias, the exposure amount, and the target value Vt of the charge potential. However, in the present embodiment, the residual potential and the charge potential of the photoconductor can be grasped without providing the potential sensor, and the image forming conditions such as the developing bias, the exposure amount, and the target value VI of the charge potential can be adjusted. As a result, the number of components can be reduced, and the size and cost of the apparatus can be reduced. Further, the residual potential is estimated from the DC charging current when the surface of the photoconductor is charged from the state where the photoconductor potential after discharging the photoconductor by light and discharge, that is, before charging, is set to approximately 0 V and the DC charging current when the surface of the photoconductor is charged from the state where discharging is performed only by light. Accordingly, the residual potential is estimated with high accuracy. Therefore, the image forming conditions can be adjusted well, and a good image can be obtained.

Further, the detection error of the current detection circuit 516*a* can be canceled by acquiring the capacitance coefficient in the actual apparatus. This is for the following reason. Once the photoconductor 40 is set in the main body, the combination of the photoconductor 40 and the current detection circuit 516*a* remains the same unless the photoconductor 40 is replaced. Therefore, the capacitance coefficient [V/μA] calculated including the detection error of the current detection circuit 516*a* is multiplied by the detection current [μA] including the error of the same current detection circuit 516*a* to obtain the charge potential [V]. Thus, the current detection error is canceled.

In the present embodiment, the estimation of the charge potential and the estimation of the residual potential, the correction of the charging voltage at the time of image formation using the estimation result of the charge potential, and the correction of the image forming condition using the estimation result of the residual potential are executed more frequently than the operation of acquiring the photoconductor characteristics. The so-called process control is executed after the power of the color copier is turned on for the first time in the morning or every 1000 sheets during the operation.

The estimation of the charge potential and the residual potential can be performed in a short time since the current detecting operation is performed only once, whereas it takes time to obtain the capacitance coefficient since the current detecting operation needs to be repeated. Therefore, in the normal adjustment, only the detection of the charge potential is performed, and the capacitance coefficient is calculated only when it is determined that the calculation of the capacitance coefficient is necessary. The case where it is determined to be necessary is limited to the case where execution is really necessary, which is less frequent than normal adjustment. Thus, the charged potential of the photoconductor can be accurately estimated in a short adjustment time. Examples of the case where the capacitance coefficient needs to be calculated include the following cases.

Case Where Photoconductor is Replaced

As described above, since there is an individual difference in film thickness for each photoconductor 40, it is necessary to calculate the capacitance coefficient when the photoconductor 40 is replaced. In an image forming apparatus in which a customer engineer replaces the photoconductor 40, the capacitance coefficient may be calculated manually when the customer engineer replaces the photoconductor 40. This manual execution instruction can be performed using the operation display unit 515. In an image forming apparatus in which a user replaces a process cartridge including the photoconductor 40, new product information may be stored in a memory mounted on the process cartridge, and the calculation of the electrostatic capacitance coefficient may be automatically executed when the process cartridge is mounted on the main body.

Case Where Photoconductor is Used in Excess of Predetermined Amount

During repeated use, the photoconductive layer of the photoconductor 40 is gradually worn out, and thus the electrostatic capacitance changes. Therefore, it is desirable to store the rotation time of the photoconductor 40, the number of output sheets, and the like, and to execute the calculation of the capacitance coefficient when the amount of wear of the photoconductive layer reaches an estimated amount indicating the progress of wear of the photoconductive layer. Since the progress of the abrasion of the photoconductive layer is greatly influenced by the formulation of the photoconductor 40, cleaning conditions, and the like, the estimated amount may be appropriately set according to each apparatus. In addition to the wear of the photoconductive layer, the fatigue of the photoconductor due to the use over time may require a larger amount of current to eliminate the trap in the photoconductor. Therefore, even in an apparatus using a photoconductor in which the abrasion of the photoconductive layer is small, it is desirable to calculate the capacitance coefficient when the photoconductive layer is used in an amount exceeding a predetermined amount.

Case Where Use Environment Changes

From the experimental results, the inventors have found that even when the same photoconductor 40 is used in different environments, the calculated capacitance coefficient differs. This phenomenon does not mean that the capacitance itself of the photoconductor 40 is changed. The charging power supply (high-voltage power supply) detects the current flowing through the charging roller 70 and does not detect the current flowing through the photoconductor (the flow in which the holes generated in the charge generation layer (CGL) cancel the surface charge). Therefore, the inventors presume that, depending on the environment, a difference in the relationship between the charging current and the charge potential might be caused by a difference in the moving speed of the holes. It is desirable that the use environment is monitored by a temperature and humidity sensor installed in the image forming apparatus, and the calculation of the capacitance coefficient is re-executed when the capacitance coefficient is changed by a predetermined amount or more (for example, 5 g/m$^3$ or more in absolute humidity) from the previous calculation of the capacitance coefficient.

Case Where High-Voltage Power Supply is Replaced Due to Failure or the Like

Although this case hardly occurs, it is desirable to recalculate the capacitance coefficient when the charging power supply (high-voltage power supply) is replaced due to a failure or the like, since the capacitance coefficient is calculated based on the combination of the photoconductor 40 and the current detection circuit 516*a*. In this case, since the customer engineer replaces the high-voltage power supply, the customer engineer may manually perform the replacement.

Further, in the present embodiment, in the DC charging current detecting operation, the DC charging current in the first rotation and the DC charging current in the second rotation are detected, and the estimation of the charge potential and the estimation of the residual potential are performed. However, only the estimation of the charge potential may be performed in the DC charging current detecting operation.

Figure 10:
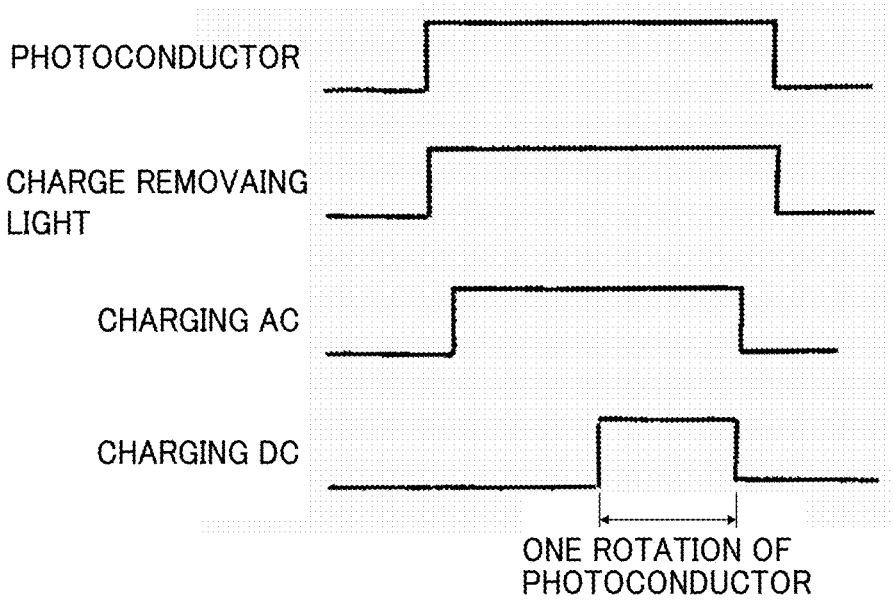
FIG. 10 is a timing chart of the acquisition operation of the DC charging current value for estimating only the charge potential.

FIG. 10 is a timing chart of the operation of obtaining the DC charging current value for only estimating the charge potential. As illustrated in FIG. 10, in the case where only the estimation of the charge potential is performed, the photoconductor 40 is rotated one or more times from the application of the charging AC and charges of the entire surface of the photoconductor are removed by light and discharge. Then, a predetermined charging DC bias (for example, −700 V) is applied from the charging power supply 516 until the photoconductor 40 rotates once, and the charging current at this time is detected. In this manner, performing only the estimation of the charge potential allows the DC charging current value detecting operation to be completed by one rotation of the photoconductor 40 and be performed in a shorter time than the DC charging current detecting operation.

In the present embodiment, charges on the photoconductor 40 are removed by discharge of the charging roller 70. However, in some embodiments, another charger for charge removal may be provided separately from the charging roller 70.

The embodiments described above are examples and, for example, attain advantages below in the following aspects.

Aspect 1

An image forming apparatus includes a photoconductor such as the photoconductor 40, a charger such as a charging roller 70 to charge the photoconductor, and a charge remover (the charge removing lamp 72 and the charging roller 70 in the above-described embodiment) to discharge the photoconductor. The surface potential of the photoconductor after charging by the charger is estimated based on a characteristic value, such as a capacitance coefficient, of the photoconductor and a value of a current flowing through the charger after charge removal by the charge remover. A charging bias applied to the charger is controlled based on the estimated surface potential of the photoconductor. The charge remover removes charge from the surface of the photoconductor by light and electric discharge. According to such a configuration, since charge removal is performed on the photoconductor by light and electric discharge, the photoconductor can be destaticized better than the case where charge removal is performed on the photoconductor only by the light. Therefore, as compared with the case where charge removal is performed on the photoconductor only by light, the current flowing through the charger can be restrained from being affected by the residual potential of the photoconductor. Thus, the surface potential of the photoconductor can be accurately estimated from the value of the current flowing through the charger.

Aspect 2

In Aspect 1, the residual potential of the photoconductor such as the photoconductor 40 after the charge remover removes charge from the surface of the photoconductor only with light is estimated based on a value of a current flowing through the charger such as the charging roller 70 when the charger charges the photoconductor after the charge remover removes charge from the surface of the photoconductor with light and electric discharge, a value of a current flowing through the charger when the charger charges the photoconductor after the charge remover removes charge from the surface of the photoconductor only with light, and the characteristic value of the photoconductor. An image forming condition is adjusted based on the estimated residual potential of the photoconductor. Accordingly, as described in the above-described embodiment, the residual potential of the photoconductor can be estimated with high accuracy. Therefore, image forming conditions can be adjusted well, and a good image can be obtained.

Aspect 3

In Aspect 1 or 2, a charge removing operation on the photoconductor by light and electric discharge is performed for two or more rotations of the photoconductor. As described in the above-described embodiment, such a configuration can destaticize the photoconductor to approximately 0 V regardless of the use conditions of the photoconductor.

Aspect 4

In any one of Aspects 1 to 3, an operation of acquiring the characteristic value such as a capacitance coefficient of the photoconductor through repeatedly performing a cycle of charge removal by the charge remover and charging by the charger, and an operation of estimating the charge potential of the photoconductor through performing only once the cycle of charge removal by the charge remover and charging by the charger are executable. As described in the above-described embodiment, such a configuration can restrain deterioration of the estimation accuracy of the charge potential due to a change in characteristics of the photoconductor over time.

Aspect 5

In Aspect 4, the operation of acquiring the characteristic value such as the capacitance coefficient of the photoconductor is an operation of measuring, a plurality of times, the value of the current flowing through the charger when the charger charges the photoconductor after charge removal by light and electric discharge, while changing the charging bias applied to the charger. As described in the above-described embodiment, such a configuration can restrain deterioration of the estimation accuracy of the charge potential due to a change in characteristics of the photoconductor over time.

Aspect 6

In Aspect 4 or 5, the operation of acquiring the characteristic value of the photoconductor such as the photoconductor 40 is performed when a specific condition is satisfied. As described in the above-described embodiment, such a configuration can reduce the downtime as much as possible and restrain the deterioration of the estimation accuracy of the charge potential.

Aspect 7

In Aspect 6, the specific condition is a condition whose occurrence frequency is lower than an occurrence frequency of the operation of estimating the charge potential of the photoconductor such as the photoconductor 40. As described in the above-described embodiment, such a configuration can reduce the downtime as much as possible and restrain the deterioration of the estimation accuracy of the charge potential.

Aspect 8

In Aspect 6 or 7, the case where the specific condition is satisfied is a case where the photoconductor is replaced. As described in the above-described embodiment, since there is an individual difference in characteristics of the photoconductor due to manufacturing variations of the photoconductor, the estimation accuracy of the charge potential can be maintained by acquiring the characteristic value of the photoconductor when the photoconductor is replaced.

Aspect 9

In Aspect 6 or 7, the case where the specific condition is satisfied is a case where the use environment is changed by a predetermined amount or more. As described in the above-described embodiment, since the relationship between the charging current and the charge potential changes depending on the use environment, the estimation accuracy of the charge potential can be maintained by acquiring the characteristic value of the photoconductor when the use environment changes.

Aspect 10

In Aspect 6 or 7, the case where the specific condition is satisfied is a case where the photoconductor is used by a predetermined amount or more. As described in the above-described embodiment, the capacitance of the photoconductor changes when the photoconductor is worn due to long-term use. Further, due to the fatigue of the photoconductor, a larger amount of current is required to eliminate the trap in the photoconductor. Accordingly, the relationship between the charging current and the charge potential is changed. By periodically acquiring the characteristic value of the photoconductor, the estimation accuracy of the charge potential can be maintained.

Aspect 11

In Aspect 6 or 7, the image forming apparatus includes a current detector such as the current detection circuit 516*a* to detect the value of the current flowing through the charger such as the charging roller 70 and a charging power supply such as the charging power supply 516 to apply the charging bias to the charger. The case where the specific condition is satisfied is a case where the charging power supply is replaced. As described in the above-described embodiment, when the characteristic value of the photoconductor is acquired by a combination of the photoconductor and the current detector such as the current detection circuit 516*a* mounted on a high-voltage charging power supply, the characteristic value of the photoconductor can be acquired again in order to maintain the estimation accuracy of the charge potential when the high voltage power supply is replaced.

Aspect 12

In any one of Aspects 1 to 11, the characteristic value such as the capacitance coefficient of the photoconductor is an amount of change in charge potential with respect to an amount of change in charging current. Such a configuration can accurately estimate the charge potential of the photoconductor.

Aspect 13

In any one of Aspects 1 to 12, the image forming apparatus includes a charging power supply such as the charging power supply 516 to apply the charging bias to the charger such as the charging roller 70. The charging power supply such as the charging power supply 516 can generate a direct current and an alternating current. The charge removal of the surface of the photoconductor such as the photoconductor 40 by the electric discharge of the charge remover is performed by applying an alternating current bias of the charging power supply such as the charging power supply 516 to the charger. According to such a configuration, since the surface of the photoconductor is destaticized by the charging power supply such as the charging power supply 516 that applies the charging bias to the charger such as the charging roller 70, the cost increase of the image forming apparatus can be restrained as compared with the case where a power supply for removing charge from the surface of the photoconductor by electric discharge is provided separately from the charging power supply such as the charging power supply 516 to apply the charging bias to the charger.

The above-described embodiments are illustrative and do not limit the present disclosure. In addition, the embodiments and modifications or variations thereof are included in the scope and the gist of the invention, and are included in the invention described in the claims and the equivalent scopes thereof. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus, comprising:

a photoconductor;

a charger that charges the photoconductor;

a charge remover that removes charge from a surface of the photoconductor by light and electric discharge; and control circuitry configured to:

estimate a surface potential of the photoconductor, after the photoconductor is charged by the charger, based on a characteristic value of the photoconductor and a first value of a first current flowing through the charger after the charge remover removes charge from the photoconductor;

control a charging bias applied to the charger based on the surface potential;

estimate a residual potential of the photoconductor, after the charge remover removes charge from the surface of the photoconductor only by light discharge, based on:

a second value of a second current flowing through the charger when the charger charges the photoconductor after the charge remover removes charge from the surface of the photoconductor by light and electric discharge, a third value of a third current flowing through the charger when the charger charges the photoconductor after the charge remover removes charge from the surface of the photoconductor only by light discharge, and the characteristic value of the photoconductor; and adjust image forming conditions based on the residual potential.

2. An image forming apparatus, comprising:

a photoconductor;

a charger that charges the photoconductor;

a charge remover that removes charge from a surface of the photoconductor by light and electric discharge; and control circuitry configured to:

estimate a surface potential of the photoconductor, after the photoconductor is charged by the charger, based on a characteristic value of the photoconductor and a value of a current flowing through the charger after the charge remover removes charge from the photoconductor; and control a charging bias applied to the charger based on the surface potential:

acquire the characteristic value of the photoconductor by controlling the charge remover and the charger to repeatedly perform a cycle of charge removal by the charge remover and charging by the charger; and estimate a charge potential of the photoconductor by controlling the charge remover and the charger to perform only once the cycle of charge removal by the charge remover and charging by the charger.

3. The image forming apparatus according to claim 2, wherein to acquire the characteristic value of the photoconductor, the control circuitry is configured to measure, a plurality of times, a value of a current flowing through the charger when the charger charges the photoconductor after the charge remover removes charge from the photoconductor by light and electric discharge while changing the charging bias applied to the charger.

4. The image forming apparatus according to claim 2, wherein the control circuitry is configured to acquire the characteristic value of the photoconductor in a case that a specific condition is satisfied.

5. The image forming apparatus according to claim 4, wherein the specific condition is a condition having a first occurrence frequency that is less than a second occurrence frequency of estimating the charge potential of the photoconductor.

6. The image forming apparatus according to claim 4, wherein the specific condition is satisfied in a case that the photoconductor is replaced.

7. The image forming apparatus according to claim 4, wherein the specific condition is satisfied in a case that a use environment is changed by a predetermined amount or more.

8. The image forming apparatus according to claim 4, wherein the specific condition is satisfied in a case that the photoconductor is used by a predetermined amount or more.

9. The image forming apparatus according to claim 4, further comprising:

a current detector that detects a value of a current flowing through the charger; and a charging power supply that applies the charging bias to the charger, wherein the specific condition is satisfied in a case that the charging power supply is replaced.

10. The image forming apparatus according to claim 2, wherein the characteristic value of the photoconductor is an amount of change in charge potential with respect to an amount of change in charging current.

11. The image forming apparatus according to claim 2, further comprising a charging power supply configured to apply the charging bias to the charger, wherein the charging power supply generates a direct current and an alternating current, and the charging power supply applies an alternating current bias to the charger so that the charge remover removes charge from the surface of the photoconductor.

12. The image forming apparatus according to claim 2, wherein the control circuitry is configured to control the charge remover to remove charge from the photoconductor by light and electric discharge for two or more rotations of the photoconductor.

13. A control device for an image forming apparatus including a photoconductor, a charger and a charge remover, the control device comprising:

control circuitry configured to:

estimate a surface potential of the photoconductor, after the photoconductor is charged by the charger, based on a characteristic value of the photoconductor and a value of a current flowing through the charger after the charge remover removes charge from the photoconductor; and control a charging bias applied to the charger based on the surface potential;

acquire the characteristic value of the photoconductor by controlling the charge remover and the charger to repeatedly perform a cycle of charge removal by the charge remover and charging by the charger; and estimate a charge potential of the photoconductor by controlling the charge remover and the charger to perform only once the cycle of charge removal by the charge remover and charging by the charger.

14. The control device according to claim 13, wherein to acquire the characteristic value of the photoconductor, the control circuitry is configured to measure, a plurality of times, a value of a current flowing through the charger when the charger charges the photoconductor after the charge remover removes charge from the photoconductor by light and electric discharge while changing the charging bias applied to the charger.

15. The control device according to claim 13, wherein the control circuitry is configured to acquire the characteristic value of the photoconductor in a case that a specific condition is satisfied.

16. The control device according to claim 15, wherein the specific condition is a condition having a first occurrence frequency that is less than a second occurrence frequency of estimating the charge potential of the photoconductor.

17. The control device according to claim 15, wherein the specific condition is satisfied in a case that the photoconductor is replaced.

18. The control device according to claim 15, wherein the specific condition is satisfied in a case that a use environment is changed by a predetermined amount or more.

19. The control device according to claim 15, wherein the specific condition is satisfied in a case that the photoconductor is used by a predetermined amount or more.

20. The control device according to claim 15, further comprising:

a current detector that detects a value of a current flowing through the charger; and a charging power supply that applies the charging bias to the charger, wherein the specific condition is satisfied in a case that the charging power supply is replaced.

* * * * *